US005673912A

United States Patent [19]

Bonk

[11] Patent Number: 5,673,912

[45] Date of Patent: Oct. 7, 1997

[54] TABLE FOOTBALL GAME

[76] Inventor: Laurie Rae Bonk, 764 Hope St., Ormond Beach, Fla. 32174

[21] Appl. No.: 676,070

[22] Filed: Jul. 5, 1996

[51] Int. Cl.[6] ..... A63C 9/00

[52] U.S. Cl. ..... 273/108.4; 273/317.5; 273/440

[58] Field of Search ..... 273/128 R, 65 R, 273/317.5, 108.1, 108.4, 108.5, 285, 428, 440

[56] References Cited

U.S. PATENT DOCUMENTS

| | | | |
|---|---|---|---|
| 3,239,226 | 3/1966 | Matte | 273/108.1 |
| 4,555,114 | 11/1985 | Dozier | 273/128 R |
| 4,733,867 | 3/1988 | Kemp et al. | 273/108.4 |
| 4,762,323 | 8/1988 | Blagg . | |
| 4,802,880 | 2/1989 | Shaw | 273/428 |
| 5,257,783 | 11/1993 | Callaghan | 273/128 R |
| 5,465,976 | 11/1995 | Gonzalez | 273/428 |

*Primary Examiner*—William M. Pierce

[57] ABSTRACT

The present invention relates to a table football game (10) which comprises a table football (12) having a flat configuration. The table football game (10) further comprises a table (14) which comprises a first table edge (14A) and a second table edge (14B). The first table edge (14A) and the second table edge (14B) are positioned on opposing sides of the table (14). The table football game (10) further comprises at least one first player (18A) performing an action selected from a group consisting of first player's kick (18AA), first player's goal (18AB), first player's palm (18AC), first player's finger shooting (18AD), and first player's palm shooting (18AE). The table football game (10) further comprises at least one second player (18B) performing an action selected from a group consisting of second player's kick (18B A), second player's goal (18B B), second player's palm (18B C), second player's finger shooting (18B D), and second player's palm shooting (18BE). A result occurs from the action performed by the at least one first player (18A) and the at least one second player (18B). The result is selected from a group consisting of table football touchdown (20) having table football touchdown points (20A) associated therewith, table football extra point (22), table football two-point conversion (24), table football field goal (26) having table football field goal points (26) associated therewith, table football bonk (28) having table football bonk points (28A) associated therewith, and winning points (30).

10 Claims, 3 Drawing Sheets

TABLE FOOTBALL GAME

BACKGROUND OF THE INVENTION

1. Field of the Invention

The present invention relates to a table football game. More particularly, the present invention relates to table football game played with a flat triangular football simulating regular football at miniaturized level.

2. Description of the Prior Art

Football is the most popular of all professional sports currently played in the United States. However, football requires numerous persons as team members and at least two teams as well as a large playing field. The table football game only requires two players and a small table such that it can be played virtually anywhere. In the prior art them exists electronic football games as well as compact table top football games with miniaturized football players but the present invention, table football game is novel and unique.

Numerous innovations for football games have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to a table football game. More particularly, the present invention relates to table football game played with a flat triangular football simulating regular football at miniaturized level.

The types of problems encountered in the prior art are numerous players are required as well as a large playing field.

In the prior art, unsuccessful attempts to solve this problem were attempted namely: miniaturizing football players and a miniaturized playing field. However, the problem was solved by the present invention because it requires only two players and no special equipment except the table football and a standard commonly available table.

Innovations within the prior art are rapidly being exploited in the field of games.

The present invention went contrary to the teaching of the art which teaches electronic football games and miniaturized football players as well as miniaturized playing field.

The present invention solved a long felt need for an easily portable football game which requires the minimum amount of equipment.

A synergistic effect was produced utilizing the present invention due to the following facts and results from experimentation: novis players learned the standard game of football at an excellerated rate rather than simply watching television.

Accordingly, it is an object of the present invention to provide a table football game.

More particularly, it is an object of the present invention to provide a table football which comprises a table football.

In keeping with these objects, and with others which will become apparent hereinafter, one feature of the present invention resides, briefly stated, in the table football game it is able to be played on a standard table having a first table edge and a second table edge.

When the table football game is designed in accordance with the present invention, it further comprises an edger.

In accordance with another feature of the present invention, a first player can perform actions selected from a group consisting of first player's kick, first player's goal, first player's palm, first player's finger shooting, and first player's palm shooting.

Yet another feature of the present invention is that a second player is capable of performing actions selected from a group consisting of second player's kick, second player's goal, second player's palm, second player's finger shooting, and second player's palm shooting.

Still another feature of the present invention is that a table football touchdown can result in table football touchdown points.

Yet still another feature of the present invention is that a table football extra point can be achieved.

Still yet another feature of the present invention is that a table football two-point conversion can be achieved.

Another feature of the present invention is that a table football field goal can result in table football field goal points.

Yet another feature of the present invention is that table football bonk can result in table football bonk points.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—table football game (10)
12—table football (12)
14—table (14)
14A—table edge (14A)
14B—second table edge (14B)
16—edger (16)
18A—first player (18A)
18AA—first player's kick (18AA)
18AB—first player's goal (18AB)
18AC—first player's palm (18AC)
18AD—first player's finger shooting (18AD)
18AE—first player's palm shooting (18AE)
18B—second player (18B)
18BA—second player's kick (18BA)
18BB—second player's goal (18BB)
18BC—second player's palm (18BC)
18BD—second player's finger shooting (18BD)
18BE—second player's palm shooting (18BE)
20—table football touchdown (20)
20A—table football touchdown points (20A)
22—table football extra point (22)
24—table football two-point conversion (24)
26—table football field goal (26)
26A—table football field goal points (26)
28—table football bonk (28)
28A—table football bonk points (28A)
30—winning points (30)

METHOD OF SCORING TABLE FOOTBALL TOUCHDOWN POINTS (20A) WHILE PLAYING A TABLE FOOTBALL GAME (110)

112—positioning (112) a first player (18A) at first table edge (14A) of a table (14) and a second player (18B) at an opposite second table edge (14B) of the table (14)

114—placing (114), by the first player (18A), a table football (12) overhanging the first table edge (14A)

116—shooting (116), by the first player (18A), the table football (12) toward the opposite second table edge (14B)

118—measuring (118) how dose the table football (12) shot by the first player (18A) is to the opposite second table edge (14B)

120—placing (120), by the second player (18B), a table football (12) overhanging the second table edge (14B)

122—shooting (122), by the second player (18B), the table football (12) toward the opposite first table edge (14A)

124—measuring (124) how dose the table football (12) shot by the second player (18B) is to the opposite first table edge (14A)

126—determining (126) if the table football (12) shot by the first player (18A) is closest to the second table edge (14B) as compared to the table football (12) shot by the second player (1 8B) is closest to the first table edge (14A)

128—choosing (128) a player (18A, 18B) who shot the the table football (12) closest to the opposite table edge (14B,14A)

130—first shooting (130), by the chosen player (18A, 18B), the table football (12) toward the opposite table edge (14B, 14A)

132—second shooting (130), by the other player (18B, 18A), the table football (12) toward the opposite table edge (14A, 14B)

134—repeating shooting (134) until one player (14A, 14B) shoots the table football (12) overhanging the opposite table edge (14B, 14A) resulting in a table football touchdown (20)

136—scoring (130), by the one player (18A, 18B), a predetermined mount of table football touchdown points (20A)

METHOD OF SCORING A TABLE FOOTBALL EXTRA POINT (22) WHILE PLAYING A TABLE FOOTBALL GAME (110)

138—placing (138) the table football (12) by the one player (18A, 18B) approximately three inches away from the table edge (14A, 14B)

140—performing (140) a player's goal (18BB, 18AB) by the other player (18B, 18A) at the opposite table edge (14B, 14A)

142—performing (142) a player's kick (18AA, 18BA) by the one player (18A, 18B) toward the other player's goal (18BB, 18AB)

144—scoring (144) the table football extra point (22), by the one player (14A, 14B), when the table football (12) goes between the other player's goal (18BB, 18AB)

METHOD OF SCORING A TABLE FOOTBALL TWO-POINT CONVERSION (24) WHILE PLAYING A TABLE FOOTBALL GAME (110)

146—placing (146) the table football (12) by the one player (18A, 18B) approximately three inches away from the table edge (14A, 14B)

148—performing (148) a player's palm (18BC, 18AC) by the other player (18B, 18A) at the opposite table edge (14B, 14A)

150—performing (150) a player's kick (18AA, 18BA) by the one player (18A, 18B) toward the other player's palm (18BC, 18AC)

152—scoring (152) the table football two-point conversion (24), by the one player (14A, 14B), when the table football (12) hits player's palm (18BC, 18AC)

METHOD OF SCORING A TABLE FOOTBALL FIELD GOAL (26) WHILE PLAYING A TABLE FOOTBALL GAME (110)

154—placing (154) the table football (12) by the one player (18A, 18B) approximately three inches away from the table edge (14A, 14B)

156—performing (156) a player's goal (18BB, 18AB) by the other player (18B, 18A) at the opposite table edge (14B, 14A)

158—performing (158) a player's kick (18AA, 18BA) by the one player (18A, 18B) toward the other player's goal (18BB, 18AB)

160—scoring (160) a pre-determined number of table football field goal points (26) for the table football field goal (26), by the one player (14A, 14B), when the table football (12) goes between the other player's goal (18BB, 18AB)

METHOD OF SCORING A TABLE FOOTBALL TWO-POINT CONVERSION (24) WHILE PLAYING A TABLE FOOTBALL GAME (110)

162—placing (162) the table football (12) by the one player (18A, 18B) approximately three inches away from the table edge (14A, 14B)

164—performing (164) a player's palm (18BC, 18AC) by the other player (18B, 18A) at the opposite table edge (14B, 14A)

166—performing (166) a player's kick (18AA, 18BA) by the one player (18A, 18B) toward the other player's palm (18BC, 18AC)

168—scoring (168) a pre-determined number of table football bonk points (28A) points for the table football bonk (28), by the one player (14A, 14B), from when the table football (12) hits player's palm (18BC, 18AC)

METHOD OF WINNING A TABLE FOOTBALL GAME (110)

170—playing (170) the table football game until a player (18A, 18B) scores a predetermined number of winning points (30)

DESCRIPTION OF THE PREFERRED EMBODIMENT

Figure 1B:
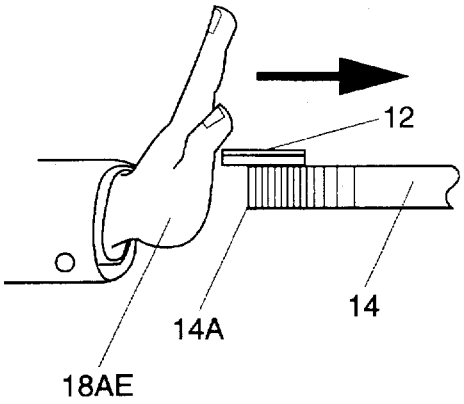
FIG. 1B is a side perspective view of a first player's palm shooting.
Figure 1A:
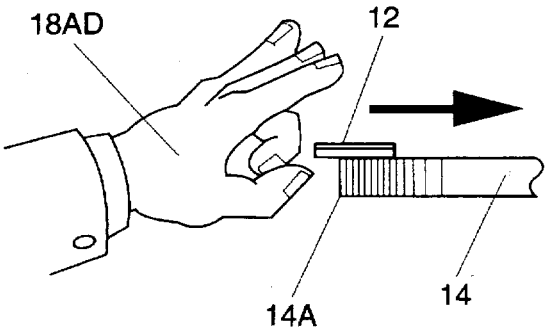
FIG. 1A is a side perspective view of a first player's finger shooting.
Figure 2:
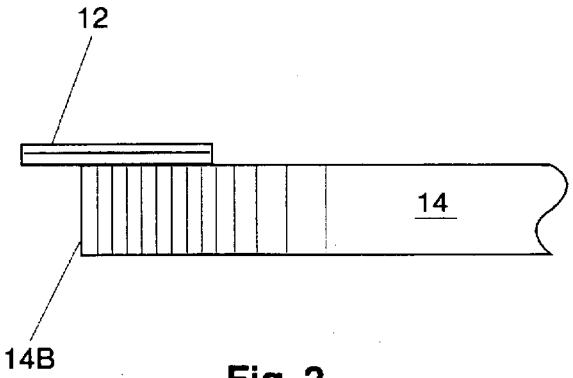
FIG. 2 is a side view of a table football overhanging a second table edge.
Figure 2A:
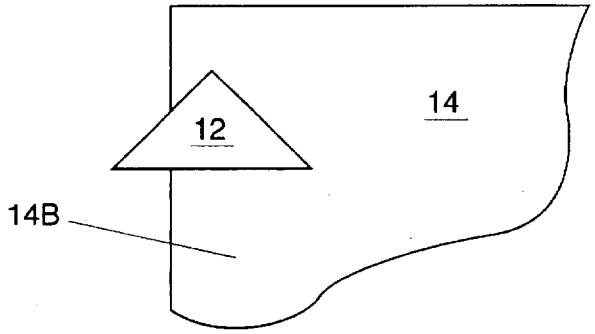
FIG. 2A is a top view of a table football (12) overhanging a second table edge.

Firstly, referring to FIG. 1A and FIG. 1B which are a side perspective view of a first player's finger shooting (18AD) and a first player's palm shooting (18AE), respectively. FIG. 2 and FIG. 2A are a side view and top view of a table football (12) overhanging a second table edge (14B), respectively. A table football touchdown (20) is achieved when one player (18A, 18B) performs a player's shooting (18AD, 18AE, 18BD, 18BE). Each player (18A, 18B) takes turns performing a player's shooting (18AD, 18AE, 18BD, 18BE) toward the other player's (18B, 18A) table edge (14B, 14A). The method of scoring table football touchdown points (20A) while playing a table football game (110) consists of the flowing step:

A) positioning (112) a first player (18A) at first table edge (14A) of a table (14) and a second player (18B) at an opposite second table edge (14B) of the table (14);

B) placing (114), by the first player (18A), a table football (12) overhanging the first table edge (14A);

C) shooting (116), by the first player (18A), the table football (12) toward the opposite second table edge (14B);

D) measuring (118) how dose the table football (12) shot by the first player (18A) is to the opposite second table edge (14B);

E) placing (120), by the second player (18B), a table football (12) overhanging the second table edge (14B);

F) shooting (122), by the second player (18B), the table football (12) toward the opposite first table edge (14A);

G) measuring (124) how close the table football (12) shot by the second player (18B) is to the opposite first table edge (14A);

H) determining (126) if the table football (12) shot by the first player (18A) is closest to the second table edge (14B) as compared to the table football (12) shot by the second player (18B) is closest to the first table edge (14A);

I) choosing (128) a player (18A, 18B) who shot the table football (12) closest to the opposite table edge (14B, 14A);

J) first shooting (130), by the chosen player (18A, 18B), the table football (12) toward the opposite table edge (14B, 14A);

K) second shooting (130), by the other player (18B, 18A), the table football (12) toward the opposite table edge (14A, 14B);

L) repeating shooting (134) until one player (14A, 14B) shoots the table football (12) overhanging the opposite table edge (14B, 14A) resulting in a table football touchdown (20); and M) scoring (130), by the one player (18A, 18B), a predetermined mount of table football touchdown points (20A).

Figure 3:
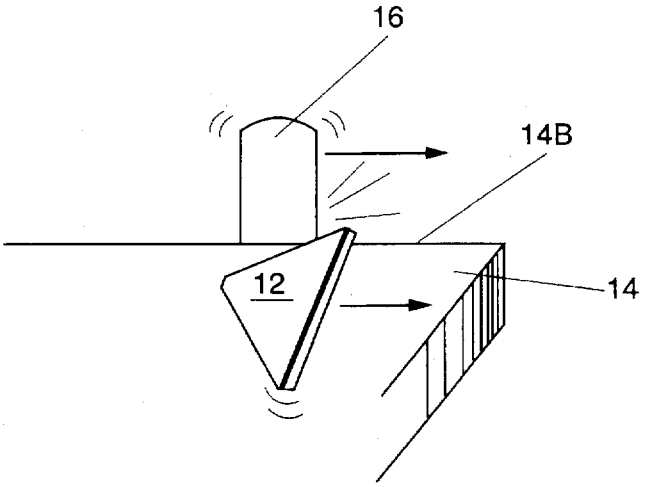
FIG. 3 is a top-side perspective view of a table football being checked by an edger to determine of it is overhanging a second table edge.

Referring to FIG. 3 which is a top-side perspective view of a table football (12) being checked by an edger (16) to determine of it is overhanging a second table edge (14B). Once one player (18A, 18B) performs a player's kick (18AA, 18BA) a determination must be made if the table football (12) is overhanging the table edge (14B, 14A). When the opposing player (18B, 18A) slides the edger (16) along the table edge (14B, 14A) and it contacts and moves the table football (12), a table football touchdown (20) is achieved and the one player (18A, 18B) receives table football touchdown points (20A) the table football (12) is constructed from a material selected from a group consisting of paper, paper composite, plastic, plastic composite, fiberglass, epoxy, carbon-graphite, rubber, rubber composite, metal, metal alloy, wood, stone and ceramic.

Figure 4:
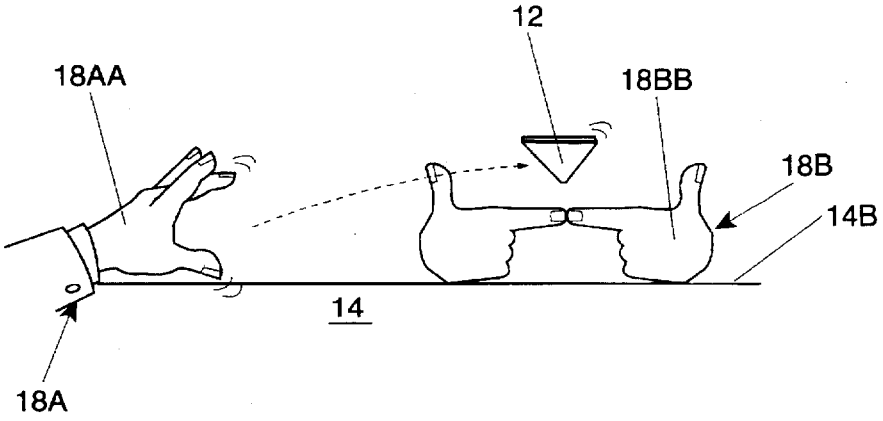
FIG. 4 is a top-side perspective view of a first player performing a first player's kick toward a second player performing a second player's goal.
Figure 5:
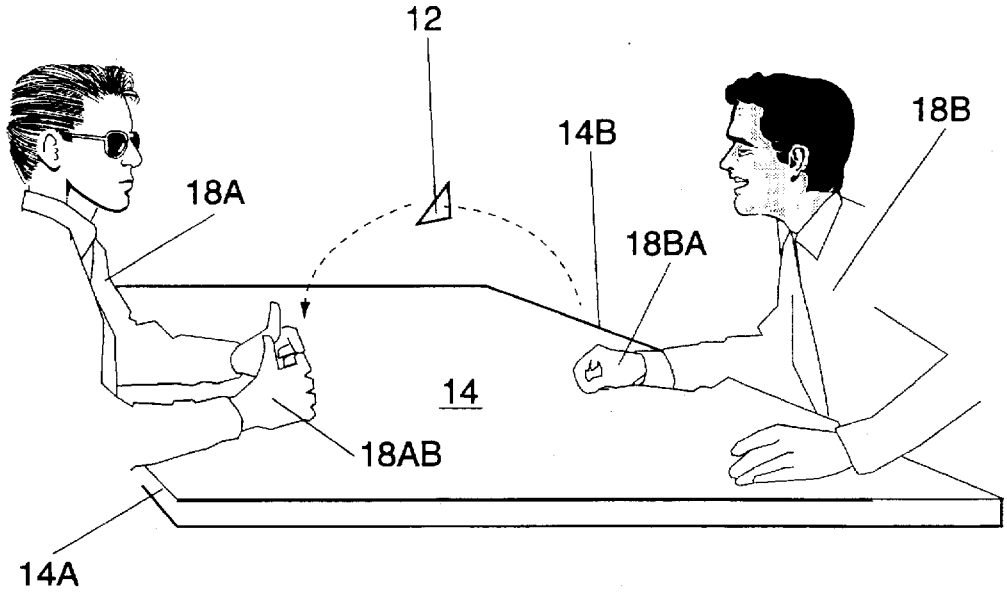
FIG. 5 is a top-side perspective view of a second player performing a second player's kick toward a first player performing a first player's goal.

Referring to FIG. 4 which is a top-side perspective view of a first player (18A) performing a first player's kick (I8AA) toward a second player (18B) performing a second player's goal (18BB). FIG. 5 is a top-side perspective view of a second player (18B) performing a second player's kick (18BA) toward a first player (18A) performing a first player's goal (18AB). The table football extra point (22) may be attempted after each table football touchdown (20). Eye protection is recommended for the player (18A, 18B) who is performing player's goal (18AB, 18BB). The method of scoring a table football extra point (22) while playing a table football game (110) consists of the following steps:

A) placing (138) the table football (12) by the one player (18A, 18B) approximately three inches away from the table edge (14A, 14B);

B) performing (140) a player's goal (18BB, 18AB) by the other player (18B, 18A) at the opposite table edge (14B, 14A);

C) performing (142) a player's kick (18AA, 18BA) by the one player (18A, 18B) toward the other player's goal (18BB, 18AB).

D) scoring (144) the table football extra point (22), by the one player (14A, 14B), when the table football (12) goes between the other player's goal (18BB, 18AB).

The table football field goal (26) is scored in the same manner as the table football extra point (22). The method of scoring a table football field goal (26) while playing a table football game (110) consists of the following steps:

A) placing (154) the table football (12) by the one player (18A, 18B) approximately three inches away from the table edge (14A, 14B);

B) performing (156) a player's goal (18BB, 18AB) by the other player (18B, 18A) at the opposite table edge (14B, 14A);

C) performing (158) a player's kick (18AA, 18BA) by the one player (18A, 18B) toward the other player's goal (18BB, 18AB); and D) scoring (160) a pre-determined number of table football field goal points (26) for the table football field goal (26), by the one player (14A, 14B), when the table football (12) goes between the other player's goal (18BB, 18AB).

Figure 6:
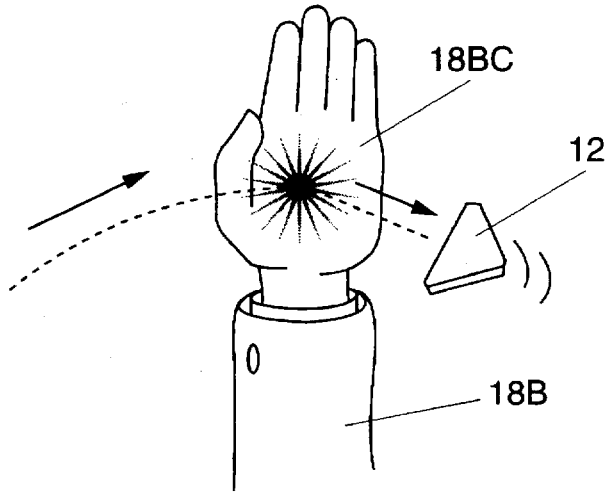
FIG. 6 is a top-side perspective view of the table football hitting the second player performing a second player's palm.

Referring to FIG. 6 which is a top-side perspective view of the table football (12) hitting the second player (18B) performing a second player's palm (18BC). A table football two-point conversion (24) may be attempted in place of a table football extra point (22). When the player (18A, 18B) performs a player's palm (18AC, 18BC), it is preferable that he/she rests his/her elbow on the table (14) with the player's palm (18AC, 18BC) facing the opposing player (18B, 18A) who is performing a player's kick (18BA, 18AA). The method of scoring a table football two-point conversion (24) while playing a table football game (110) consists of the following steps:

A) placing (146) the table football (12) by the one player (18A, 18B) approximately three inches away from the table edge (14A, 14B);

B) performing (148) a player's palm (18BC, 18AC) by the other player (18B, 18A) at the opposite table edge (14B, 14A);

C) performing (150) a player's kick (18AA, 18BA) by the one player (18A, 18B) toward the other player's palm (18BC, 18AC); and D) scoring (152) the table football two-point conversion (24), by the one player (14A, 14B), when the table football (12) hits player's palm (18BC, 18AC).

The table football table football bonk (28) is scored in the same manner as the table football two-point conversion (24). The method of scoring a table football table football bonk

(28) while playing a table football game (110) consists of the following steps:

A) placing (162) the table football (12) by the one player (18A, 18B) approximately three inches away from the table edge (14A, 14B);

B) performing (164) a player's palm (18BC, 18AC) by the other player (18B, 18A) at the opposite table edge (14B, 14A);

C) performing (166) a player's kick (18AA, 18BA) by the one player (18A, 18B) toward the other player's palm (18BC, 18AC); and D) scoring (168) a pre-determined number of table football bonk points (28A) points for the table football bonk (28), by the one player (14A, 14B), from when the table football (12) hits player's palm (18BC, 18AC).

It will be understood that each of the elements described above, or two or more together, may also find a useful application in other types of constructions differing from the type described above.

While the invention has been illustrated and described as embodied in a table football game, it is not intended to be limited to the details shown, since it will be understood that various omissions, modifications, substitutions and changes in the forms and details of the device illustrated and in its operation can be made by those skilled in the art without departing in anyway from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A method of scoring table football touchdown points (20A) while playing a table football game (110) utilizing a table football game (10) which comprises a table football (12) having a flat configuration, a table (14) which comprises a first table edge (14A) and a second table edge (14B), the first table edge (14A) and the second table edge (14B) are positioned on opposing sides of the table (14), at least one first player (18A) performing an action selected from a group consisting of first player's kick (18AA), first player's goal (18AB), first player's palm (18AC), first player's finger shooting (18AD), and first player's palm shooting (18AE), at least one second player (18B) performing an action selected from a group consisting of second player's kick (18B A), second player's goal (18B B), second player's palm (18B C), second player's finger shooting (18B D), and second player's palm shooting (18BE), and a result occurring from the action performed by the at least one first player (18A) and the at least one second player (18B), the result is selected from a group consisting of table football touchdown (20) having table football touchdown points (20A) associated therewith, table football extra point (22), table football two-point conversion (24), table football field goal (26) having table football field goal points (26) associated therewith, table football bonk (28) having table football bonk points (28A) associated therewith, and winning points (30), the table football game (10) further comprises an edger (16) functioning to determine of a table football (12) is overhanging the table edge (14A, 14B), the method of scoring table football touchdown points (20A) while playing a table football game (110) consists of the steps of:

A) positioning (112) a first player (18A) at first table edge (14A) of a table (14) and a second player (18B) at an opposite second table edge (14B) of the table (14);

B) placing (114), by the first player (18A), a table football (12) overhanging the first table edge (14A);

C) shooting (116), by the first player (18A), the table football (12) toward the opposite second table edge (14B);

D) measuring (118) how close the table football (12) shot by the first player (18A) is to the opposite second table edge (14B);

E) placing (120), by the second player (18B), a table football (12) overhanging the second table edge (14B);

F) shooting (122), by the second player (18B), the table football (12) toward the opposite first table edge (14A);

G) measuring (124) how close the table football (12) shot by the second player (18B) is to the opposite first table edge (14A);

H) determining (126) if the table football (12) shot by the first player (18A) is closest to the second table edge (14B) as compared to the table football (12) shot by the second player (18B) is closest to the first table edge (14A);

I) choosing (128) a player (18A, 18B) who shot the table football (12) closest to the opposite table edge (14B, 14A);

J) first shooting (130), by the chosen player (18A, 18B), the table football (12) toward the opposite table edge (14B, 14A);

K) second shooting (130), by the other player (18B, 18A), the table football (12) toward the opposite table edge (14A, 14B);

L) repeating shooting (134) until one player (14A, 14B) shoots the table football (12) overhanging the opposite table edge (14B, 14A) resulting in a table football touchdown (20);

M) scoring (130), by the one player (18A, 18B), a predetermined mount of table football touchdown points (20A);

N) scoring a table football table football bonk (28) while playing a table football game (110) consisting of the following steps:

O) placing (162) the table football (12) by the one player (18A, 18B) approximately three inches away from the table edge (14A, 14B);

P) performing (164) a player's palm (18BC, 18AC) by the other player (18B, 18A) at the opposite table edge (14B, 14A);

Q) performing (166) a player's kick (18AA, 18BA) by the one player (18A, 18B) toward the other player's palm (18BC, 18AC); and R) scoring (168) a pre-determined number of table football bonk points (28A) points for the table football bonk (28), by the one player (14A, 14B), from when the table football (12) hits player's palm (18BC, 18AC).

2. The method of scoring table football touchdown points (20A) while playing a table football game (110) as described in claim 1 further comprises a method of scoring a table football extra point (22) while playing a table football game (110) consisting of the following steps:

A) placing (138) the table football (12) by the one player (18A, 18B) approximately three inches away from the table edge (14A, 14B);

B) performing (140) a player's goal (18BB, 18AB) by the other player (18B, 18A) at the opposite table edge (14B, 14A);

C) performing (142) a player's kick (18AA, 18BA) by the one player (18A, 18B) toward the other player's goal (18BB, 18AB); and D) scoring (144) the table football extra point (22), by the one player (14A, 14B), when the table football (12) goes between the other player's goal (18BB, 18AB).

3. The method of scoring table football touchdown points (20A) while playing a table football game (110) as described in claim 1 further comprises a method of scoring a table football two-point conversion (24) while playing a table football game (110 )consisting of the following steps:

A) placing (146) the table football (12) by the one player (18A, 18B) approximately three inches away from the table edge (14A, 14B);

B) performing (148) a player's palm (18BC, 18AC) by the other player (18B, 18A) at the opposite table edge (14B, 14A);

C) performing (150) a player's kick (18AA, 18BA) by the one player (18A, 18B) toward the other player's palm (18BC, 18AC); and D) scoring (152) the table football two-point conversion (24), by the one player (14A, 14B), when the table football (12) hits player's palm (18BC, 18AC).

4. The method of scoring table football touchdown points (20A) while playing a table football game (110) as described in claim 1 further comprises a method of scoring a table football field goal (26) while playing a table football game (110) consisting of the following steps:

A) placing (154) the table football (12) by the one player (18A, 18B) approximately three inches away from the table edge (14A, 14B);

B) performing (156) a player's goal (18BB, 18AB) by the other player (18B, 18A) at the opposite table edge (14B, 14A);

C) performing (158) a player's kick (18AA, 18BA) by the one player (18A, 18B) toward the other player's goal (18BB, 18AB); and D) scoring (160) a pre-determined number of table football field goal points (26) for the table football field goal (26), by the one player (14A, 14B), when the table football (12) goes between the other player's goal (18BB, 18AB).

5. The method of scoring table football touchdown points (20A) while playing a table football game (110) as described in claim 13 further comprises a method of scoring a table football table football bonk (28) while playing a table football game (110) consisting of the following steps:

A) placing (162) the table football (12) by the one player (18A, 18B) approximately three inches away from the table edge (14A, 14B);

B) performing (164) a player's palm (18BC, 18AC) by the other player (18B, 18A) at the opposite table edge (14B, 14A);

C) performing (166) a player's kick (18AA, 18BA) by the one player (18A, 18B) toward the other player's palm (18BC, 18AC); and D) scoring (168) a pre-determined number of table football bonk points (28A) points for the table football bonk (28), by the one player (14A, 14B), from when the table football (12) hits player's palm (18BC, 18AC).

6. The method of scoring table football touchdown points (20A) while playing a table football game (110) as described in claim 1 further comprises a method of winning a table football game (110) consisting of the following step:

A) playing (170) the table football game until a player (18A, 18B) scores a predetermined number of winning points (32).

7. The method of scoring table football touchdown points (20A) while playing a table football game (110) as described in claim 4, wherein the pre-determined number of table football field goal points (26) is three points.

8. The method of scoring table football touchdown points (20A) while playing a table football game (110) as described in claim 1, wherein the pre-determined number of table football bonk points (28A) is five points.

9. The method of scoring table football touchdown points (20A) while playing a table football game (110) as described in claim 6, wherein the predetermined number of winning points (32) is thirty-five.

10. The method of scoring table football touchdown points (20A) while playing a table football game (110) as described in claim 1, wherein the table football (12) is constructed from a material selected from a group consisting of paper, paper composite, plastic, plastic composite, fiberglass, epoxy, carbon-graphite, rubber, rubber composite, metal, metal alloy, wood, stone and ceramic.

* * * * *